United States Patent [19]

Gubler et al.

[11] Patent Number: 4,471,715

[45] Date of Patent: Sep. 18, 1984

[54] BOOTH FOR SPRAY-COATING ARTICLES

[75] Inventors: Roland Gubler; Christian Muttner, both of Schweiz, Fed. Rep. of Germany

[73] Assignee: Ransburg-Gema AG, Switzerland

[21] Appl. No.: 388,013

[22] Filed: Jun. 14, 1982

[30] Foreign Application Priority Data

Aug. 10, 1981 [DE] Fed. Rep. of Germany ..... 3131565

[51] Int. Cl.[3] ..... B05C 15/00

[52] U.S. Cl. ..... 118/324; 118/326; 118/634; 118/DIG. 7

[58] Field of Search ..... 118/326, 634, DIG. 7, 118/324, 323; 55/302; 98/115 SB

[56] References Cited

U.S. PATENT DOCUMENTS

| | | | |
|---|---|---|---|
| 4,227,900 | 10/1980 | Nichols et al. | 55/302 |
| 4,245,551 | 1/1981 | Berkmann | 118/326 |
| 4,303,417 | 10/1981 | Koch | 118/326 |

FOREIGN PATENT DOCUMENTS

| | | | |
|---|---|---|---|
| 1962698 | 6/1971 | Fed. Rep. of Germany . | |
| 2212254 | 9/1973 | Fed. Rep. of Germany . | |
| 2946436 | 5/1980 | Fed. Rep. of Germany . | |
| 2277627 | 12/1973 | France . | |
| 2369878 | 7/1978 | France | 118/634 |
| WO81/00362 | 2/1981 | PCT Int'l Appl. . | |
| WO81/02117 | 8/1981 | PCT Int'l Appl. . | |

*Primary Examiner*—John P. McIntosh

*Attorney, Agent, or Firm*—Ostrolenk, Faber, Gerb & Soffen

[57] ABSTRACT

A spray-coating booth having on its side walls several air cleaners with easily interchanged and cleaned filter units that are relatively light in weight and can be carried by hand. In accordance with the design of the booth, the dimensions of the spray-coating area can be varied and the filter units can be interchanged with other types of units such as sprayers. Undesirable accumulation of powder is avoided because the air cleaners continuously precipitate powder filtered from the air. Powder transporting means within the booth, which may be inclined chutes with a fluidized bed, transport this excess powder from beneath the air cleaners at the side wall to the floor of the booth. The floor of the booth extends below the entire spray coating region and thereby also serves to collect excess spray powder which falls directly upon it. The powder is then returned for use to the spray-coating region.

30 Claims, 4 Drawing Figures

BOOTH FOR SPRAY-COATING ARTICLES

BACKGROUND OF THE INVENTION

This invention relates to a spray booth, in which articles are spray-coated with powder.

Such a booth is disclosed in German Offenlegungsschriften Nos. 2 731 123 and 2 809 020. Exhaust-air cleaners mounted on the side walls draw powder-charged air across the inside of the booth and withdraw the air from the booth through filters. The powder removed from the air by the filters precipitates into gutter-like receptacles under the filters and outside the booth. The floor of the booth is a smooth-surfaced chute that slopes down at an angle to its length, in such a manner that the powder that falls on the floor will slip sideways out of the booth into the gutter-like receptacles.

Another booth, disclosed in German Offenlegungsschrift No. 2 945 934, consists of three units, of which only the middle unit constitutes an actual spraying area. The sprayers are mounted on side walls. There is a mesh-covered powder receptacle mounted underneath the booth and extending over its entire area. The floor of the receptacle is fluidized and captures the powder as it falls. Powder-transport lines lead from the receptacle to the sprayer. The two end units are entrance and exit locks that house blowers and exhaust-air filters. The blowers draw powder-charged air along the length of the booth, from within the middle unit, through lateral slits in the end units, and finally, into the filters. Reversing the direction of air flow through the filters causes the powder collected on them to fall to the fluidized floor. The disadvantages of this spray booth are that its length cannot be utilized so that the actual spraying area may be varied and that it takes up too much room. Also, the path of air from the spraying area to the filters in the lock units at each end is long and indirect, necessitating the use of high-output blowers which consume a great deal of power. The powder that drops off the filters cannot be returned to the middle unit continuously, but only in the intervals between spray coating and then only by using a strong countercurrent.

German OFfenlengungsschrift No. 2 946 436 and German Auslegeschrift No. 2 546 920 disclose spray booths in which the exhaust air is drawn down through the floor. The disadvantage of this method is that while the powder should remain around the articles being coated as long as possible, the fall of the powder is instead accelerated.

German Offenlegungsschrift No. 2 835 474 discloses a booth with exhaust-air cleaners immediately under the spray-coating area. All of the falling powder drops onto the filters.

As used herein, "powder" is defined as coating materials with particles ranging in size from powdery to granular. A "fluidized floor" or fluidized surface is defined as one through which a gas, usually air, is blown through a large number of openings to form a cushion that supports the particles of powder. A "spraying station" is defined as any point along the booth at which spray guns can be or are positioned for spray coating.

SUMMARY OF THE INVENTION

The present invention provides a spray-coating booth that is compact, requires little power, does not cause pollution, is easy to clean, can be cleared of undesirable concentrations of powder without interrupting operation and without the use of strong air currents and retains the powder in the vicinity of the articles being spray-coated for a relatively long period of time. In addition, a spray coating booth according to the present invention features exhaust-air cleaners with filters that are easy to clean and change, a spray-coating area with dimensions (particularly length) that are easy to vary, spray-coaters that can be interchanged with exhaust-air cleaners, and exhaust-air cleaners that can be replaced with wall panels that can be opened to permit cleaning of the booth or coating of the articles manually with spray guns.

These goals are achieved by using a transport means located within the booth for transporting the powder precipitated by the exhaust gas cleaners (which are mounted in the side walls of the booth) from the side walls below the cleaners to a powder collecting surface which comprises the floor of the booth and extends under substantially the entire spray coating region. The powder collecting surface collects excess powder sprayed by the sprayers. The transport means may comprise a series of inclined guides with fluidized surfaces. Preferably the powder collecting surface comprises a centrally located powder collection opening and a series of interconnected panels which form a continuous surface sloping down from the walls, the entrance and the exit of the booth toward the central opening. The side walls of the booth may have bays which house at least one air cleaner. A plurality of transport means transport powder from under the air cleaner within the bays to the powder collecting surface.

A spray booth according to the invention has many advantages. The filters may be small and easily changed. Transverse air conduction is optimized, ensuring a stable cloud of powder around the articles being spray coated. The location of filters in the air cleaners at critical points prevents powder from escaping from the booth. The exhaust air is substantially completely purified without the use of after-filters. The powder being recovered may be treated gently when cleaning the filter elements with a reversed air current, thus preventing the impact of high-speed powder particles against components of the booth and friction between the particles and the components. When the powder or filters are changed, only approximately fifty percent of the surface of the inside walls of the booth requires cleaning. The inside of the booth is readily accessible because of the large openings that are left when the filters are removed for cleaning. The powder slides as easily as possible over the slightly inclined, preferably fluidized, floor below the filters and inside the booth. There is no dangerous accumulation of powder on the walls and floor. The accessibility of the walls makes them easy to clean. Recovered powder may be sifted before entering a powder receptacle which is located to receive powder from the central powder opening in the powder collecting surface. It is easy to gain access to and change the powder receptacle. The channel from the powder receptacle to the spray guns is short and direct. Spray guns or sprayers can be mounted at any point along the side walls of the booth. Construction is compact. Only occasional cleaning of the filters is necessary. Finally, powder falling from the filters will drop to the transport means continuously, without the use of a countercurrent, which would affect the entire spraying region, and will be carried over the floor of the booth and into the powder receptacle.

BRIEF DESCRIPTION OF THE DRAWINGS

For the purpose of illustrating the invention, the drawings shown an embodiment which is presently preferred. The invention is not limited, however, to the precise arrangements and instrumentalities shown.

DETAILED DESCRIPTION OF THE PREFERRED EMBODIMENT

Figure 1:
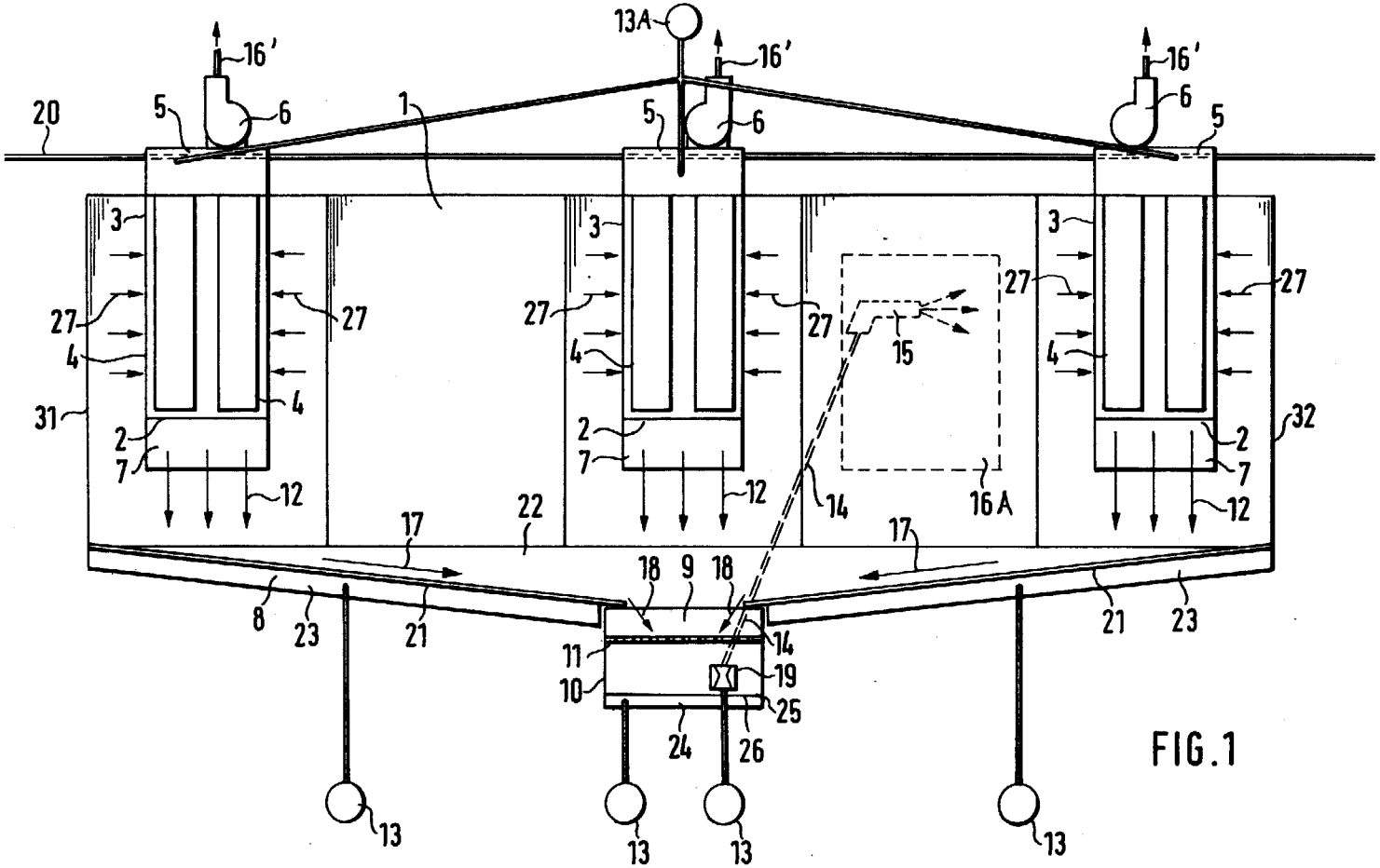
FIG. 1 is a longitudinal section through a spray-coating booth according to the invention in which some of the elements are represented schematically.

FIG. 1 shows a spray booth in which articles 16A are transported through the booth by a conveyor 20 from an entrance 31 to an exit 32. Conveyor 20 is preferably located midway between the side wall of the booth (as may be more fully appreciated with reference to FIG. 2). The side wall 1 of the booth may have, for example, three bays 2. In each bay is an exhaust-air cleaner 3 having, for example, two filters 4, above which are mounted air-current reversers 5 and blowers 6. Blower 6 draws air from inside the booth through filters 4. Periodic momentary operation of air current reversers 5 serves to substantially continuously precipitate powder from air filters 4 during spraying. The entire interior of the booth can be used as a spray-coating area. Powder falling from filters 4 drops onto powder transport means or guides 7, which are in the form of chutes with floors that slope down toward the inside of the booth, and then in the direction indicated by the arrow 12 onto the floor 8 of the booth and over the floor in the direction indicated by the arrows 17 and 18 through an opening 9 and into a receptacle 10. The powder that precipitates directly onto the floor 8 as a result of gravity will also slide into receptacle 10. It is preferable for powder receptacle 10 to be covered with a mesh 11 to keep out coarse contaminants. Gas supplied from a compressed-gas source 13 draws powder from receptacle 10 through an injection pipe 19 and pumps it through a line 14 to a sprayer or spray gun 15 to coat articles 16A. At least one other compressed-gas source 13A supplies gas to air-current reversers 5 in exhaust-air cleaners 3. Arrows 27 indicate the essentially horizontal direction in which exhaust air containing powder is pumped from inside the booth through filters 4 in exhaust-air cleaners 3. Air 16' that has been pumped out of the booth through filters 4 and expelled from blowers 6 has had enough powder removed from it so that it can generally be released directly into the surrounding working area.

The floor 8 of the booth is fludized. It comprises two longitudinal panels 21 inclined downward along the booth toward opening 9 and two transverse panels 22 inclined downward across the booth toward opening 9. All four of these panels are perforated by a large number of holes. Below floor panels 21 and 22 are fluidizing compartments 23 that are connected to compressed-gas sources 13. Air from these compartments forms a cushion on which the particles of powder float above perforated floor plates 21 and 22. If transverse panels 22 incline abruptly enough and are not very high, they do not need to be perforated and their surface can be smooth. In this case, it will be adequate for longitudinal panels 21 to be fluidized by use of compartments 23.

The floor 26 of receptacle 10 is also fluidized with a similar fluidizing compartment 24 covered by a similar perforated panel 25.

Figure 2:
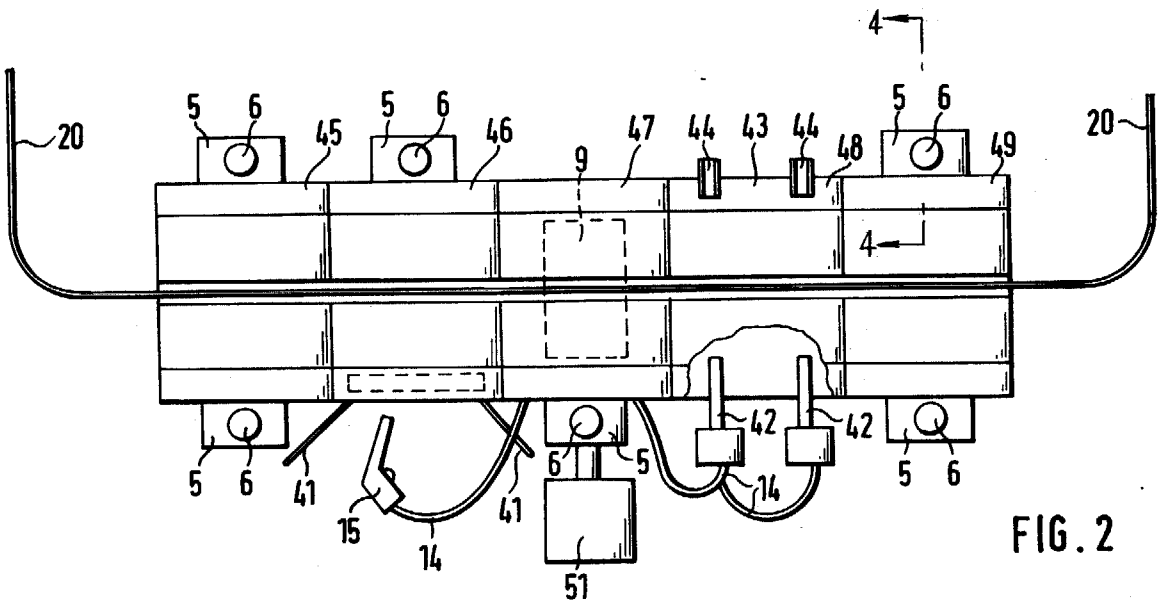
FIG. 2 is a top view of the booth of FIG. 1.

As shown in FIG. 2, in a booth according to the invention, access to a spraying station may be through a wall panel with doors 41. A manually operated spray gun 15 or automatic spray guns 42 can be used. Doors 41 also permit access to the inside of the booth. In FIG. 2 spraying stations with manual spray guns 15 and automatic spray guns 42 are all mounted on the same side of the booth. Spraying stations 43 that have prefabricated wall panels with slits 44 through which spray guns 15 or 42 can be inserted can also be positioned on the other side of the booth.

An important advantage of the invention is that spraying stations can be located along the wall opposite exhaust-air cleaners 3. The booth is designed modularly to allow exhaust-air cleaners 3 and sprayers employing spray guns 15 or 42 to be mutually interchangeable. This is possible because exhaust-air cleaners 3 return powder recovered from the air to areas of the floor and walls of the booth that have been designed to receive excess spray coating powder.

The embodiment illustrated in FIG. 2 comprises a series of five units 45, 46, 47, 48 and 49. The number of units can be varied as desired. Exhaust-air cleaners on one side of the booth can also be interchanged with cleaners or sprayers on the other side. A powder reservoir 51 supplies fresh powder to receptacle 10 as needed.

Figure 4:
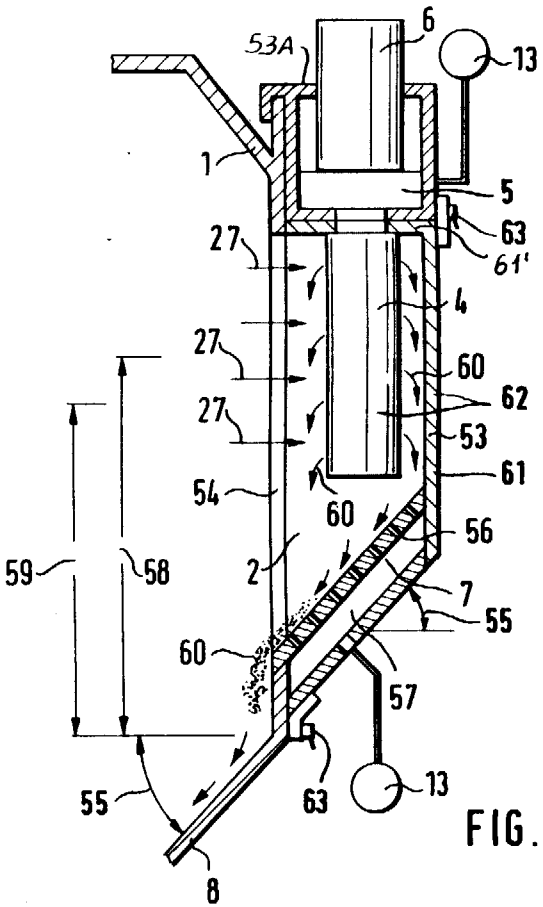
FIG. 4 is a transverse section through one of the bays in the booth, taken generally along line 4—4 of FIG. 2.
Figure 3:
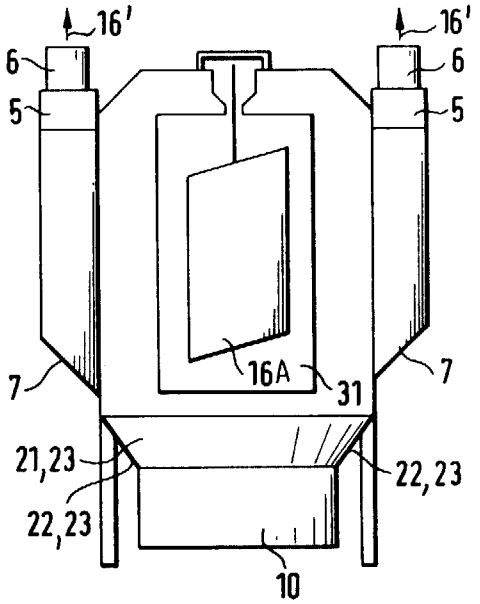
FIG. 3 is a simplified end view of the booth of FIG. 2.

FIG. 4 shows in greater detail a bay 2 comprising housing 53 which contains filters 4, air current reverser 5 and blower 6 which together comprise an air cleaner 3. Housing 53 is configured so as to be easily mounted or dismounted over cutout 54 in side wall 1. Powder transport means or guides 7 in the form of chutes under filters 4 can be closed and smooth-surfaced if their angle of slope 55 as measured from the horizontal is steep enough so that the powder will slide off their top surface. In this case, angle 55 should be at least 45° and preferably 57.5°. Preferably, the individual parts of the floor 8 of the booth should slope at the same angle as angle 55. In the embodiment in FIG. 4 guide 7, in addition to being sloped at a steep angle, also has a fluidized floor comprising a perforated covering panel 56 and a fluidizing compartment 57 connected to a source of compressed-gas 13.

Exhaust air is drawn from inside the booth more or less horizontally in the directions shown by arrows 27, but preferably it is drawn in at a slightly upward inclination to filters 4. This may increase the length of time during which the powder stays in the air. For this reason, the midpoint elevation 58 of filters 4 at least equals and preferably exceeds the midpoint elevation 59 of the spray coating region which may generally be, according to the invention, the entire interior volume of the booth. Powder 60 falls from filters 4. The filters 4 and outside wall 61 of each bay 2 make up an interchangeable filter unit 62. These units 62, which weigh less than 10 kg and preferably only about 5 kg, are considerably smaller and lighter than the interchangeable filter units employed in known spray-coating booths, which are often too heavy to be carried by hand. Units 62 can be carried by hand and are easily and quickly changed. A tensioning element 63 serves to force back wall 61 and its horizontal top extension 61' tightly against the lower horizontal surface of an upper housing member 53A. The use of several small exhaust-air cleaners 3 makes the booth more versatile than it would be if one large filter were used. A filter unit 62 or a whole exhaust-air cleaner 3 comprising housing 53, upper housing member 53A and their associated components can be replaced as desired. Cutouts 54 in the wall of the booth are left open during replacement, permitting access to the inside of the booth.

An important feature of the invention is that the air exhausted from the inside of the booth travels to filters 4 without deviating from the shortest path transverse to the length of the booth. Following precipitation, the powder is conducted without deviating from a path transverse to the length of the booth to the sprayers for further use. Thus, a smaller powder reserve is required than with previous booths, so that powder reservoir 51 may be of relatively small size. It is also significant that powder 60 falling off the filters 4 is continuously returned by powder transport means or sloping guides 7 to the booth, even during spray coating and without the necessity of using reverse air current through filters 4.

Instead of being fluidized as in the embodiment just described, the floor 8 and even the walls of the booth can be provided with electrodes to generate alternating electrical fields to repel the particles of powder that alight on them. Migrating alternating fields can transport such particles in a particular direction. German Pat. No. 2 248 367 discloses an apparatus in which such fields are generated. Alternatively, a conveyor belt which travels through the bottom of the booth and collects and carries off the precipitated powder may be used. An apparatus using such a belt is disclosed in German Auslegeschrift No. 2 546 920.

The present invention may be embodied in other specific forms without departing from the spirit or essential attributes thereof and accordingly, reference should be made to the appended claims, rather than to the foregoing specification as indicating the scope of the invention.

What is claimed is:

1. A booth for spray coating articles with powder, comprising:

a spray coating region in which articles are to be sprayed;

spraying means for spraying powder onto articles in the spray coating region;

a powder collecting surface extending under the entire spray coating region for collecting excess powder sprayed by the spraying means;

a side wall meeting the powder collecting surface adjacent the spray coating region; an opening defined in the side wall and spaced above the powder collecting surface;

a removable unit, including an air filter for removing powder from air drawn through the air filter mounted in the opening in the side wall and at least in part positioned outwardly of the side wall;

means connected to the removable unit for drawing air from the spray coating region through the air filter; means connected to the removable unit for precipitating powder from the air filter; and powder transport means located outwardly of the side wall for receiving powder precipitated from the air filter and for transporting the powder to the powder collecting surface in the spray coating region.

2. The booth of claim 1 in which the powder transport means comprises a chute that slopes downwardly from beneath the air filter toward the powder collecting surface.

3. The booth of claim 2 in which the chute is inclined at an angle of more than substantially 45° from the horizontal.

4. The booth of claim 2 in which the chute has a fluidized floor.

5. The booth of claim 1 in which the powder transport means comprises a chute that slopes downwardly from beneath the air filter toward the powder collecting surface with a first angle of slope and in which the powder collecting surface comprises a powder collection opening and a plurality of panels forming a surface sloping downward from the side wall to the powder collection opening with a second angle of slope, the first angle of slope being substantially equal to the second angle of slope.

6. The booth of claim 1 in which the removable unit weighs between approximately five and ten kilograms.

7. The booth of claims 1, 2 or 4 in which a vertical midpoint of the air filter is higher than a vertical midpoint of the spray coating region.

8. the booth of claims 1, 2 or 4 in which the air drawing means draws air from the spray coating region through the air filter substantially continuously during spraying.

9. The booth of claim 8, in which powder precipitating means precipitate powder removed from the air substantially continuously.

10. The booth of claims 1, 2 or 4 in which the powder transport means return precipitated powder to the powder collecting surface substantially continuously.

11. The booth of claim 1 further comprising means for conveying the articles through the spray coating region.

12. The booth of claim 1 in which the removable unit comprises a bay extending outwardly from the side wall at the spray coating region.

13. The booth of claim 1, further comprising:

a second side wall parallel to the first-mentioned side wall and meeting the powder collecting surface adjacent the spray coating region opposite the first side wall; the spray coating region having a first end and an opposite second end between the first and second side walls;

an entrance for the articles at the first end of the spray coating region; and an exit for the articles at the second end of the spray coating region.

14. The booth of claim 13 in which the powder collecting surface comprises:

a powder collection opening; and a plurality of interconnected panels forming a surface, sloping from the first and second side walls, the entrance and the exit downward to the collection opening.

15. The booth of claim 14 in which the powder collection opening is located at approximately the center of the powder collecting surface.

16. The booth of claim 14 in which at least part of the powder collecting surface is fluidized.

17. The booth of claim 14 further comprising:

a receptacle under the powder collection opening for receiving powder from the powder collecting surface; and at least one powder-delivery line for conducting powder from the receptacle to the spraying means.

18. The booth of claim 17 further comprising means for supplying fresh powder to the receptacle.

19. The booth of claim 17 in which the powder delivery line conducts powder from the receptacle directly to the spraying means.

20. The booth of claim 13 in which the spraying means are disposed along the second side wall opposite the removable unit.

21. The booth of claim 13, further comprising: pairs of openings defined in the first and second side walls at locations such that each opening of a pair thereof is opposite the other, one of the openings being the first-mentioned opening and the openings all being of the same size and shape as the first-mentioned opening.

22. The booth of claim 21, further comprising modular units each comprising a section of the first side wall and of the second side wall and having one pair of the openings in the respective sections of the first and second side walls.

23. The booth of claim 13, wherein a plurality of openings which are of the same size and shape as the first-mentioned opening, are defined in the first and second side walls.

24. The booth of claim 23, further comprising a wall panel mounted in one of the openings, and the spraying means comprise a spray gun mounted in the wall panel.

25. The booth of claim 23, further comprising doors mounted in one of the openings.

26. The booth of claim 1 in which the opening in the side wall is large enough for a person to reach through it for cleaning the inside of the booth when the removable unit is removed.

27. The booth of claim 1 in which the air filter comprises a portion through which air from the spray coating region is drawn, the portion having a vertical mid-point elevation at least as high as a mid-point elevation of the spray coating region, for drawing air nearly horizontally into the air filter from the spray coating region.

28. The booth of claim 1 in which the powder precipitating means comprises air current reverser means for reversing air movement through the air filter for precipitating the powder from the air filter.

29. A booth for spray coating articles with powder, the booth comprising:

an entrance and an exit spaced away from the entrance for the articles;

first and second opposite spaced apart side walls extending between the entrance and the exit; openings defined in the first and second side walls, and a respective bay at each opening which extends outwardly from the respective side wall; each bay comprising an outside wall outward of the respective side wall; the outside wall of at least one bay being removable;

a spray coating region between the entrance and exit and between the first and second side walls, the spray coating region having a height about the same as the height of the openings in the first and second side walls and being adjacent thereto;

spraying means disposed along at least one of the first and second side walls for spraying powder on the articles in the spray coating region;

a powder collecting surface extending under the entire spray coating region to collect excess powder sprayed by the spraying means;

a plurality of air cleaners disposed along the side walls for drawing in air containing powder from within the booth and for precipitating the powder contained in the air to a region below the air cleaners; at least one of the air cleaners comprising an air filter attached to the removable outside wall of one bay so that the removable outside wall and attached air filter form a portable unit; the one air cleaner being located at least in part outward of the respective side wall at the one bay; the air filter comprising a portion to which air is drawn, the portion having a vertical mid-point elevation at least as high as the mid-point elevation of the spray coating region; and a powder transport means located outwardly of the respective side wall for receiving powder precipitated from the air filter and for transporting the powder to the powder collecting surface in the spray coating region.

30. A booth for spray coating articles with powder, comprising:

a spray coating region in which articles are to be sprayed;

spraying means for spraying powder onto articles in the spray coating region;

a powder collecting surface extending under the entire spray coating region for collecting excess powder sprayed by the spraying means;

a first side wall meeting the powder collecting surface adjacent the spray coating region; an opening defined in the first side wall and spaced above the powder collecting surface;

a removable unit comprising a bay extending outwardly from the first side wall at the spray coating region, the removable unit including an air filter for removing powder from air drawn through the air filter mounted in the opening in the first side wall and at least in part positioned outwardly of the first side wall;

means connected to the removable unit for drawing air from the spray coating region through the air filter; means connected to the removable unit for precipitating powder from the air filter;

powder transport means located outwardly of the first side wall for receiving powder precipitated from the air filter and for transporting the powder to the powder collecting surface in the spray coating region;

a second side wall parallel to the first side wall and meeting the powder collecting surface adjacent the spray coating region opposite the first side wall; the spray coating region having a first end and an opposite second end between the first and second side walls;

both of the first and second side walls being divided along their lengths into separate sections for defining modular units each comprising a respective section of the first side wall and of the second side wall;

an entrance for the articles at the first end of the spray coating region; and an exit for the articles at the second end of the spray coating region.

* * * * *